United States Patent [19]

Trützschler

[11] 4,198,730

[45] Apr. 22, 1980

[54] WEB GUIDING DEVICE

[75] Inventor: Hans Trützschler, Mönchen-Gladbach, Fed. Rep. of Germany

[73] Assignee: Trützschler GmbH & Co. KG, Mönchen-Gladbach, Fed. Rep. of Germany

[21] Appl. No.: 920,247

[22] Filed: Jun. 29, 1978

[30] Foreign Application Priority Data

Jul. 15, 1977 [DE] Fed. Rep. of Germany ..... 2732016

[51] Int. Cl.[2] ..... D01G 15/48

[52] U.S. Cl. ..... 19/106 R; 19/150

[58] Field of Search ..... 19/150, 157, 106 R; 226/196, 199

[56] References Cited

U.S. PATENT DOCUMENTS

| | | | |
|---|---|---|---|
| 2,326,331 | 8/1943 | Chantler | 19/150 |
| 3,840,942 | 10/1974 | Thomason, Jr. | 19/150 |
| 3,946,464 | 3/1976 | Meinke et al. | 19/150 |

FOREIGN PATENT DOCUMENTS

| | | | |
|---|---|---|---|
| 461990 | 5/1975 | U.S.S.R. | 19/150 |

*Primary Examiner*—Louis Rimrodt

*Attorney, Agent, or Firm*—Spencer & Kaye

[57] ABSTRACT

A web guiding device for withdrawing and gathering a fiber web discharged by a carding machine includes a guide element which is arranged immediately downstream of the web delivering assembly of the carding machine as viewed in the direction of web advance in the carding machine and which has a hollow guiding face traversing the plane of the web. The web guiding device further includes an arrangement for adjusting the position of the guide element with respect to the web delivering assembly as a function of the rpm of at least one of the rolls thereof.

10 Claims, 5 Drawing Figures

WEB GUIDING DEVICE

BACKGROUND OF THE INVENTION

This invention relates to a device for withdrawing and gathering a fiber web from a web delivering assembly of a carding machine. The device comprises a guide element arranged immediately downstream of the web delivering assembly and having a hollow guiding face which traverses the plane of the web. Such an arrangement is described in U.S. patent application Ser. No. 887,215, filed Mar. 16th, 1978, and assigned to Trützschler GmbH & Co. KG, Mönchengladbach (Federal Replublic of Germany).

Conventionally, the operational speeds of the advancing rolls and withdrawing rolls of a carding machine are adjusted stepwise. While the main cylinder of the carding machine is initially set to the full operational rpm, the advancing rolls and withdrawing rolls, such as the feeding rolls, the doffer, the crush rolls and the calender rolls, are first set to a lower starting rpm. Only after completion of the starting phase of this rotation are the advancing rolls and withdrawing rolls set to the higher rpm, at which time the web guiding elements are manually closed. In case of malfunctioning regarding the web formation, the operational rpm's of the advancing rolls and withdrawing rolls are again set to the lower rpm and, for the purpose of repair or eliminating the cause of the disturbance, the web guiding elements are manually opened.

SUMMARY OF THE INVENTION

It is an object of the invention to provide an improved web guiding device for the automatic positioning of the guiding faces of the guide element.

This object and others to become apparent as the specification progresses, are accomplished by the invention, according to which, briefly stated, the web guiding device for withdrawing and gathering a fiber web discharged by a carding machine includes a guide element which is arranged immediately downstream of the web delivering assembly of the carding machine as viewed in the direction of the web advance in the carding machine and which has a hollow guiding face traversing the plane of the web. The web guiding device further includes an arrangement for adjusting the position of the guide element with respect to the web delivering assembly as a function of the rpm of at least one of the rolls thereof.

According to the invention, the guide elements are adjusted in their position as a function of the change in the rpm of the advancing rolls such as the feed rolls or the withdrawing rolls, for example, the doffer, the crush rolls and the calender rolls. By associating the guide element with a setting device controlled as a function of the rpm of the advancing rolls or the withdrawing rolls, as the case may be, the guide element can be automatically opened or closed in response to an rpm change.

For the adjustment of the position of the guiding faces of the guide element a measured value transducer, such as a voltage generator (dynamo) is used which is driven by at least one advancing roll or withdrawing roll and which is connected with a control device. There are further provided a setting member associated with the guiding faces and a desired value transmitter which preferably is a voltage-dependent relay. Advantageously, the adjustment of the guiding faces of the web guide element is effected in a stepless manner in response to the changes of the rpm's of the advancing rolls and withdrawing rolls. Thus, "stepless" as used here means that the guiding faces are brought from their open position directly (that is, without intermediate steps) into their closed position or conversely, in response to a predetermined rpm magnitude.

DESCRIPTION OF THE PREFERRED EMBODIMENTS

Figure 1:
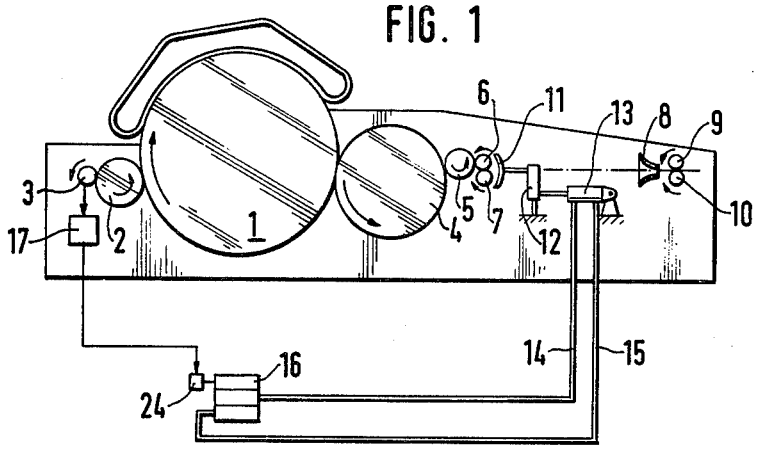
FIG. 1 is a schematic side elevational view of a carding machine incorporating the invention.

Turning now to FIG. 1, there is schematically illustrated a carding machine in which the material advances from the left towards the right. Upstream of the main cylinder 1 of the carding machine, there is arranged a lickerin 2 and a feed roll 3, while downstream of the cylinder 1, there are arranged a doffer 4, a stripper roll 5, crush rolls 6, 7, a sliver trumpet 8 and calender rolls 9 and 10. Immediately downstream of the crush rolls 6 and 7, there is arranged a web guiding device constituted by a guide element 11 supported by a hinge member 12 which is controlled by a setting device 13. The latter is connected with a control device 16 by means of conduits 14 and 15. The control device 16 is connected with a measured value transducer 17 (such as a generator) which is connected to and driven by the feed roll 3. The control device 16 is connected with a desired value transmitter 24. The control device 16 which contains—as shown schematically—stages for slow and fast rpm's, will be described in detail in conjunction with FIG. 3.

Figure 2:
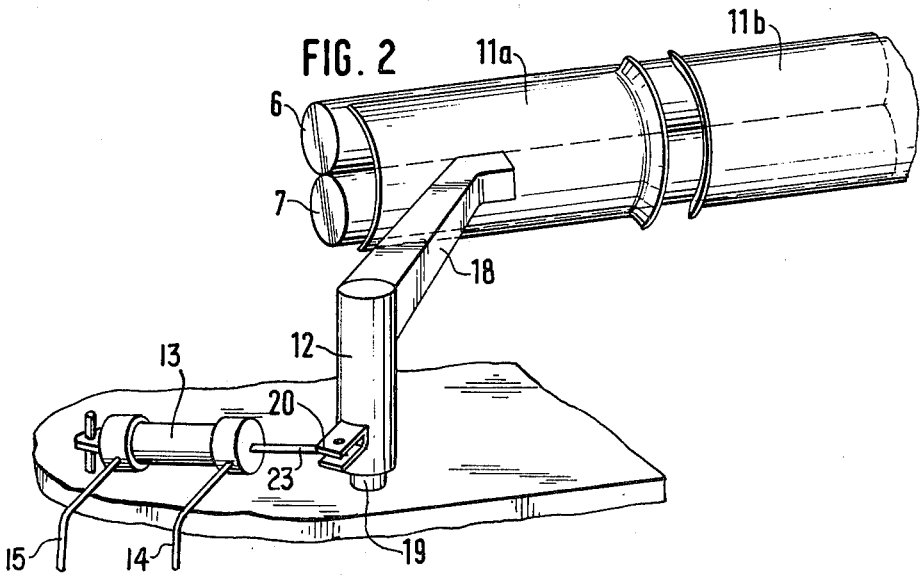
FIG. 2 is a perspective view of a web guiding device according to a preferred embodiment of the invention.

Turning now to FIG. 2, immediately downstream of the crush rolls 6 and 7, there is arranged a two-piece guide element comprising web guide portions **11*a* and 11*b***.

In the description which follows, only the support and control of the web guide portion **11*a* will be described; it will be understood that the same arrangement may be duplicated for the web guide portion 11*b***.

As seen in FIG. 2, to the web guide portion **11*a* there is affixed an arm 18 which, at its end remote from the web guide portion, is attached to a vertically oriented support sleeve 12 which, in turn, is inserted on a stationary bearing pin 19** for rotation about a vertical axis.

A lever 20 is affixed to the support sleeve 12 and is coupled with a pneumatic setting device (power cylinder) 13 which is supplied by pressurized air by conduits 14 and 15 from the control device 16 (not shown in FIG. 2) in a manner to be described in detail later. It will thus be seen that if the rpm of the feed roll 3 falls below a predetermined value set at the desired value transmitter 24, the control device 16 causes the conduit 14 to be pressurized, whereupon the setting device 13 effects an inward movement of the piston rod 23 connected to the lever 20. As a result, the lever 20 and the arm 18 secured thereto move clockwise (as viewed in FIG. 2), causing an opening movement of the web guide portion **11*a*** (that is, a motion away from the crush rolls 6 and 7). Conversely, if the rpm of the feed roll 3 exceeds a predetermined value, the web guide portion 11*a*, by virtue of the pressurization of the conduit 15 as commanded by the control device 16, moves into its closed position, that is, towards the crush rolls 6 and 7.

Figure 3:
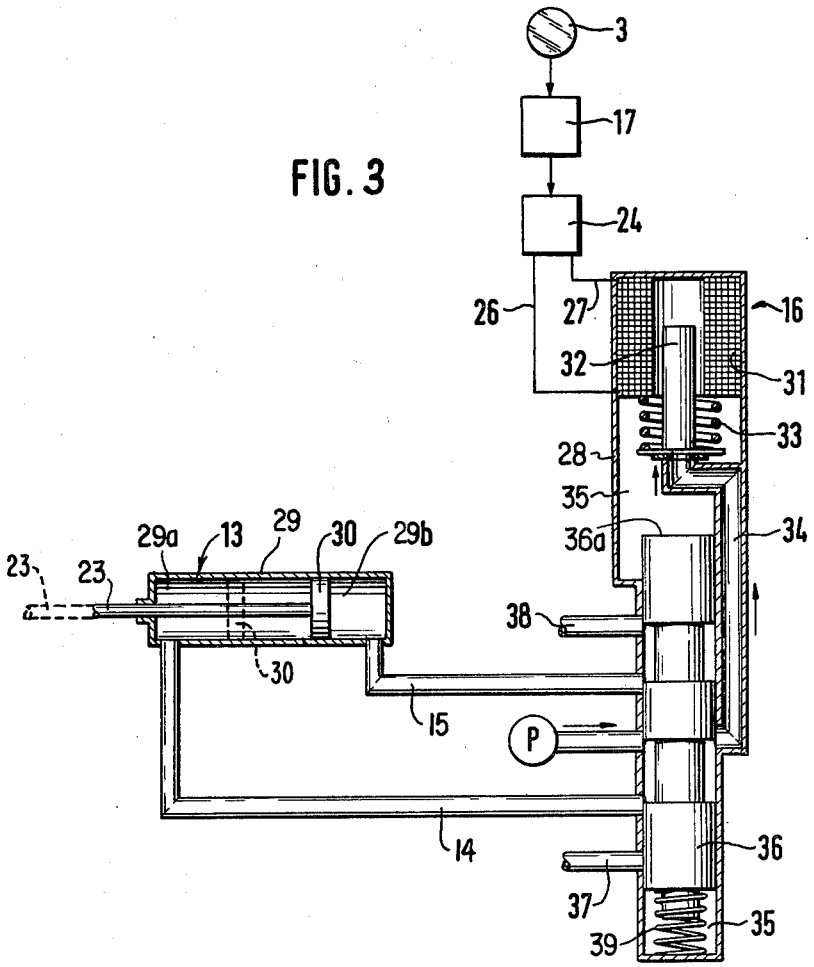
FIG. 3 is a schematic sectional view of a control device forming a part of the invention.

Details of the control device 16 and the setting device 13 connected thereto are shown in FIG. 3.

The measured value transducer 17 which is a voltage generator (dynamo) is driven by the feed roll 3 of the carding machine.

The desired value transmitter 24 is a relay, the input of which is connected to the output of the voltage generator. The output of the relay 24 is connected by means of two electrical conductors 26 and 27 with the control device 16 which essentially consists of a two-position, four-way valve comprising a valve cylinder 28 defining a valve chamber 35 and a plunger 36.

The setting memberr 13 is a fluid pressure (e.g. pneumatic) device having a pneumatic cylinder 29 and a piston 30 slidably received therein. The piston 30 divides the inside of the cylinder 29 into work chambers 29*a* and 29*b* which are connected with the valve chamber 35 by the respective conduits 14 and 15.

The control valve 16 further has a solenoid 31 which is connected with the relay 24 by means of conductors 26 and 27. An armature 32 is arranged within the solenoid 31 and has a terminus which is external to the solenoid 31 and which faces the outlet of a channel 34. The inlet of the channel 34 communicates with the valve chamber 35. The valve chamber 35 is, at the level of the inlet of the channel 34, connected with a pressurized air source P and further, has two discharge ports 37 and 38.

In case of a low rpm of the feed roll 3, the measured value transducer 17 delivers a small voltage, so that the desired value transmitting relay 24 remains inoperative (i.e., it does not respond). The armature 32 is in its position of rest into which it is urged by a spring 33 and in which it closes the outlet of the channel 34. The valve plunger 36 is, at the same time, maintained by a spring 39 in an advanced position in which the cylinder chamber 29*a* communicates with the pressure source P (via the conduit 14), while the cylinder chamber 29*b* communicates with the discharge port 38 (via the conduit 15). Thus, the piston 30 and the piston rod 23 are driven into the cylinder 29 (towards the right, into its solid-line position, as viewed in FIG. 3) and as, a result, the guide element (not shown in FIG. 2) connected to the piston rod 23 is moved into its open position.

In case the rpm of the feed roll 3 increases, the measured value transducer (voltage generator) 17 delivers a higher voltage to the relay 24 which, when the voltage exceeds a predetermined (desired) value, applies a pulse to the solenoid 31, thus causing the armature 32 to be drawn, against the force of the spring 33, into the solenoid 31, whereby the outlet of the channel 34 is opened. This causes pressurized air to enter from the source P through the channel 34 into that part of the valve chamber 35, towards which the end face 36*a* of the plunger 36 is oriented. As a result, the valve plunger 36 is displaced in a downward direction as viewed in FIG. 2, against the force of the spring 39. Thus, now the cylinder chamber 29*b* communicates with the pressure source P (via the conduit 15), while the cylinder chamber 29*a* communicates with the discharge port 37 (via the conduit 14). Consequently, the piston 30 is displaced towards the left into the phantom-line position and the guide element 11 is closed.

Figure 4:
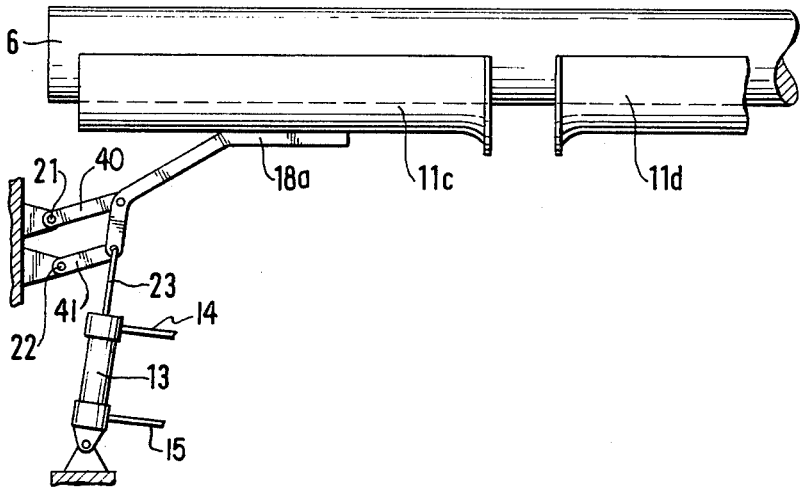
FIGS. 4 and 5 are schematic top plan views of a modified embodiment showing the web guiding device in a closed and an open position, respectively.
Figure 5:
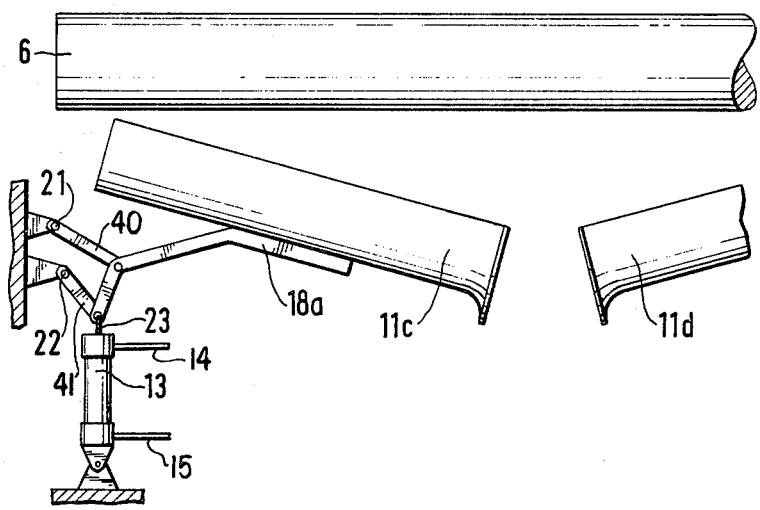

Turning now to the embodiment illustrated in FIG. 4 (closed position) and FIG. 5 (open position), to the web guide portion 11*c*, there is affixed an arm 18*a*, the other end of which is articulated to the piston rod 23 of the setting member 13. A relatively long linkage 40 is, at one end, articulated to the arm 18*a* at a location between the two ends thereof and further, a relatively short linkage 41 is articulated to the rod 23 jointly with the arm 18*a*. The respective other ends of the relatively long linkage 40 and the relatively short linkage 41 are articulated to stationary brackets 21 and 22, respectively. When the rod 23 is caused to move into the setting member 13 (by pressurizing the proper side of the setting device 13 as in the precedingly described embodiment), the linkage system 18*a*, 40 and 41 will cause the associated web guide portion 11*c* to swing from its closed position shown in FIG. 4 into its open position shown in FIG. 5. The other web guide portion 11*d* is connected to a similar linkage system and setting device.

It is to be understood that the above description of the present invention is susceptible to various modifications, changes and adaptations, and the same are intended to be comprehended within the meaning and range of equivalents of the appended claims.

What is claimed is:

1. In a device for withdrawing and gathering a fiber web discharged by a carding machine which includes advancing rolls and withdrawing rolls; at least some of the withdrawing rolls forming a web delivering assembly; the device including a guide element arranged immediately downstream of the web delivering assembly as viewed in the direction of web advance in the carding machine and having a hollow guiding face extending transversely to the direction of web advance; the improvement comprising means for adjusting the position of said guide element with respect to the web delivering assembly as a function of the rpm of at least one of said rolls.

2. A device as defined in claim 1, wherein said means comprises (a) an rpm-responsive means connected to said at least one roll for emitting a signal as a function of its rpm;

(b) a setting device connected to said guide element; and (c) a control device connected to said rpm-responsive means for receiving said signal therefrom; said control device being further connected to said setting member for adjusting said position of said guide element.

3. A device as defined in claim 2, wherein said rpm-responsive means comprises a voltage generator driven by said one roll and delivering a voltage whose magnitude is a function of the rpm of said one roll.

4. A device as defined in claim 3, wherein said voltage generator is a dynamo.

5. A device as defined in claim 3, wherein said rpm-responsive means further comprises a desired value transmitter connected to said voltage generator for receiving said voltage therefrom and for emitting a signal when said voltage reaches a predetermined value; said desired value transmitter being connected to said control device for applying said signal thereto.

6. A device as defined in claim 5, wherein said desired value transmitter is a relay which responds to a predetermined voltage.

7. A device as defined in claim 2, further comprising a source of fluid pressure; said control device comprising (a) a two-position valve having
  (1) a valve cylinder defining a valve chamber;
  (2) first and second conduits connecting said valve chamber with said setting device;
  (3) a movable valve member received in said valve chamber and having first and second positions for maintaining communication between said source and said first conduit and, respectively, between said source and said second conduit;
(b) a solenoid connected to said rpm-responsive means for receiving said signal therefrom; and
(c) means responding to the state of energization of said solenoid for establishing communication between said source and a portion of said valve chamber for displacing said movable valve member from one of its positions into the other when said solenoid is energized by said signal.

8. A device as defined in claim 7, wherein said setting member is a double-acting fluid pressure cylinder having a cylinder chamber and a piston received in said cylinder chamber and dividing said cylinder chamber into first and second work chambers communicating with said first and second conduits, respectively; said piston being displaceable in opposite directions dependent upon the pressurization of the one or the other work chamber from said source through the respective first and second conduits; and piston being connected to said guide member for adjusting its position in opposite directions dependent upon the direction of motion of said piston.

9. A device as defined in claim 7, further comprising a channel connecting said source with said portion of said valve chamber; and wherein said means responding to the state of energization of said solenoid includes an armature movable by said solenoid upon energization thereof; said armature having a first position in which it blocks said channel and a second position in which it maintains communication between said source and said portion of said valve chamber; said armature being movable from its first position to its second position upon energization of said solenoid by said signal.

10. A device as defined in claim 1, wherein said guide element has a normal operational position and an open position; and wherein said means includes an arrangement for steplessly moving said guide element from one position into the other in response to a predetermined magnitude of said rpm.

* * * * *